US006594341B1

(12) United States Patent
Lu et al.

(10) Patent No.: US 6,594,341 B1
(45) Date of Patent: Jul. 15, 2003

(54) LIQUID-FREE X-RAY INSERT WINDOW

(75) Inventors: Qing K. Lu, Aurora, IL (US); Salvatore G. Perno, Winfield, IL (US); Todd R. Bittner, Chicago, IL (US); Norman E. Wandke, Naperville, IL (US)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 09/943,612

(22) Filed: Aug. 30, 2001

(51) Int. Cl.[7] ..... H01J 35/10
(52) U.S. Cl. ..... 378/140; 378/161
(58) Field of Search ..... 378/140, 141, 378/121, 161

(56) References Cited

U.S. PATENT DOCUMENTS 4,384,360 A * 5/1983 Kitadate et al. ..... 378/199
5,987,097 A * 11/1999 Salasoo ..... 378/137
6,005,918 A 12/1999 Harris et al. ..... 378/140

FOREIGN PATENT DOCUMENTS

JP 10221498 8/1998

* cited by examiner

*Primary Examiner*—Drew A. Dunn
*Assistant Examiner*—Courtney Thomas
(74) *Attorney, Agent, or Firm*—Fay, Sharpe, Fagan, Minnich & McKee, LLP

(57) ABSTRACT

An x-ray tube assembly (16) includes a housing (40) and an insert frame (52) supported within the housing (40), such that the insert frame (52) defines a substantially evacuated envelope in which cathode (56) and anode (54) assemblies operate to produce x-rays. An x-ray transmissive window assembly (70) extends between and in a fluid-tight relationship with the housing (40) and the insert frame (52). The window assembly (70) includes an insert window (72) brazed to the insert frame (52), a top plate (76), which is connected to and substantially surrounded by a flange (78), where the flange (78) is fastened to the x-ray tube housing (40). An annular side plate (86) is connected to a fluid-tight relationship with both the insert frame/window interface (74) and the flange (78). The window assembly (70) cools the window through enhanced heat transfer while preventing housing coolant from contacting the insert window (72), thereby eliminating coolant carbonization on the window (72) and enhancing x-ray beam quality.

23 Claims, 5 Drawing Sheets

LIQUID-FREE X-RAY INSERT WINDOW

BACKGROUND OF THE INVENTION

The present invention relates to the x-ray tube art. It finds particular application in conjunction with metal insert frame x-ray tubes for use with CT scanners and the like and will be described with particular reference thereto. It is to be appreciated, however, that the invention will also find application in conjunction with conventional x-ray diagnostic systems and other penetrating radiation systems for medical and non-medical examinations.

Typically, a high power x-ray tube includes an evacuated envelope made of metal or glass, which holds a cathode filament through which a heating current is passed. This current heats the filament sufficiently that a cloud of electrons is emitted, i.e., thermionic emission occurs. A high potential, on the order of 100–200 kV, is applied between the cathode and anode, which is also located within the evacuated envelope. This potential causes the electrons to flow from the cathode to the anode through the evacuated region within the interior of the evacuated envelope. A cathode focusing cup, which houses the cathode filament, focuses the electrons onto a focal spot on the anode. The electron beam impinges the anode with sufficient energy that x-rays are generated. A portion of the x-rays generated pass through an x-ray transmissive window of the envelope to a beam limiting device or collimator, which is attached to an x-ray tube housing. The beam limiting device regulates the size and shape of the x-ray beam directed toward a patient or subject under examination, thereby allowing images of the patient or subject to be reconstructed.

During the production of x-rays, many electrons from the electron beam striking the anode are reflected from the anode and strike other regions of the x-ray tube. The reflected electrons are often referred to as secondary electrons, and the act of such reflected electrons striking other regions of the x-ray tube is often referred to as secondary electron bombardment. Accordingly, the temperature of the x-ray transmissive window or insert window rises rapidly once the anode power is applied. The rise in window temperature is caused by both the thermal radiation from the anode inside the insert frame and the secondary electron bombardment. Excessive window temperatures may destroy the window braze joints due to thermal stress caused by expansion differences between the window and the insert frame at operating temperatures.

Due to its excellent ability to withstand high voltage, oil is the preferred cooling fluid for an x-ray tube. The oil is circulated between the housing and the x-ray tube passing directly across the window of the x-ray tube. However, for a metal frame x-ray tube, the insert window receives extensive heat flux and oil cooling may not be sufficient. As a result, oil may boil locally at the insert window, depositing a layer of carbon on the window surface. Carbonization of the x-ray window significantly reduces window cooling and also deteriorates x-ray image quality due to x-ray absorption in the carbon layer.

One prior method for protecting the window from overheating includes a window heat shield, which shields a junction between the window and a metal envelope from secondary electron bombardment. Unfortunately, the heat shield method requires a heat shield material having properties of both high thermal conductivity and excellent x-ray transparency. Materials with these properties may be costly and not easily obtainable. Another prior device for protecting the x-ray window from overheating includes the use of a refrigeration cooled window joint. This method requires that a refrigeration system be attached to the x-ray tube. While this solution may serve to cool the window braze, it may be ineffective for solving the problem of oil carbonization at the center of the window. Another prior method for protecting the x-ray window from overheating includes the use of an electrode window, which is intended to deflect the back-scattered electrons, i.e., the secondary electron bombardment, from the window, therefore reducing window heat flux. However, an effective design of such a window is still unavailable.

The present invention contemplates a new and improved x-ray tube assembly having a liquid-free x-ray insert window, which overcomes the above-referenced problems and others.

SUMMARY OF THE INVENTION

In accordance with one aspect of the present invention, an x-ray tube assembly includes an x-ray tube housing, a cathode assembly, and a rotating anode assembly. An insert frame, which is supported within the x-ray tube housing, defines a substantially evacuated envelope in which the cathode and anode assemblies operate to produce x-rays. A dielectric liquid coolant flows between the x-ray tube housing and the insert frame. An x-ray transmissive window assembly extends between and in a fluid-tight relationship with the x-ray tube housing and the insert frame.

In accordance with a more limited aspect of the present invention, the x-ray transmissive window assembly includes an x-ray transmissive insert window, which is hermetically connected to the insert frame. An x-ray transmissive top plate is connected to and substantially surrounded by a flange, which is fastened to the x-ray tube housing. An annular side plate has a first end hermetically connected to at least one of the insert frame and insert window, and a second end which is connected to a bottom surface of the flange.

In accordance with a more limited aspect of the present invention, the annular side plate includes an inner surface and an extended outer surface having a plurality of fins in contact with the dielectric liquid coolant.

In accordance with another aspect of the present invention, an x-ray tube assembly includes a housing, a cathode assembly, and an anode assembly. A metal insert frame, which is disposed within the housing, defines an evacuated envelope in which the cathode and anode assemblies operate to produce x-rays. A cooling system circulates a dielectric liquid coolant between the housing and the metal insert frame. An x-ray transmissive window, through which x-rays produced by the cathode and anode assemblies pass, is brazed to the insert frame at a braze joint in a vacuum-tight manner. A cooling assembly, which is in thermal contact with the x-ray transmissive window at the braze joint, removes heat from the window without liquid coolant passing over the window.

In accordance with another aspect of the present invention, an x-ray tube assembly includes an outer housing, a metal insert frame supported within the outer housing, which defines an evacuated envelope in which cathode an anode assemblies operate to produce x-rays, and an x-ray transmissive insert window brazed to the insert frame at a braze joint. A method of cooling the x-ray transmissive insert window, in which no liquid coolant contacts the x-ray transmissive window, includes forming a fluid-free cooling chamber around and above the x-ray transmissive window and circulating a cooling fluid around the fluid-free cooling chamber.

One advantage of the present invention is that it relieves overheating of the window joint.

Another advantage of the present invention resides in increased image intensity.

Another advantage of the present invention resides in the elimination of oil carbonization on the x-ray window.

Yet another advantage of the present invention resides in reduced input power to achieve a selected x-ray output.

Other benefits and advantages of the present invention will become apparent to those skilled in the art upon a reading and understanding of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
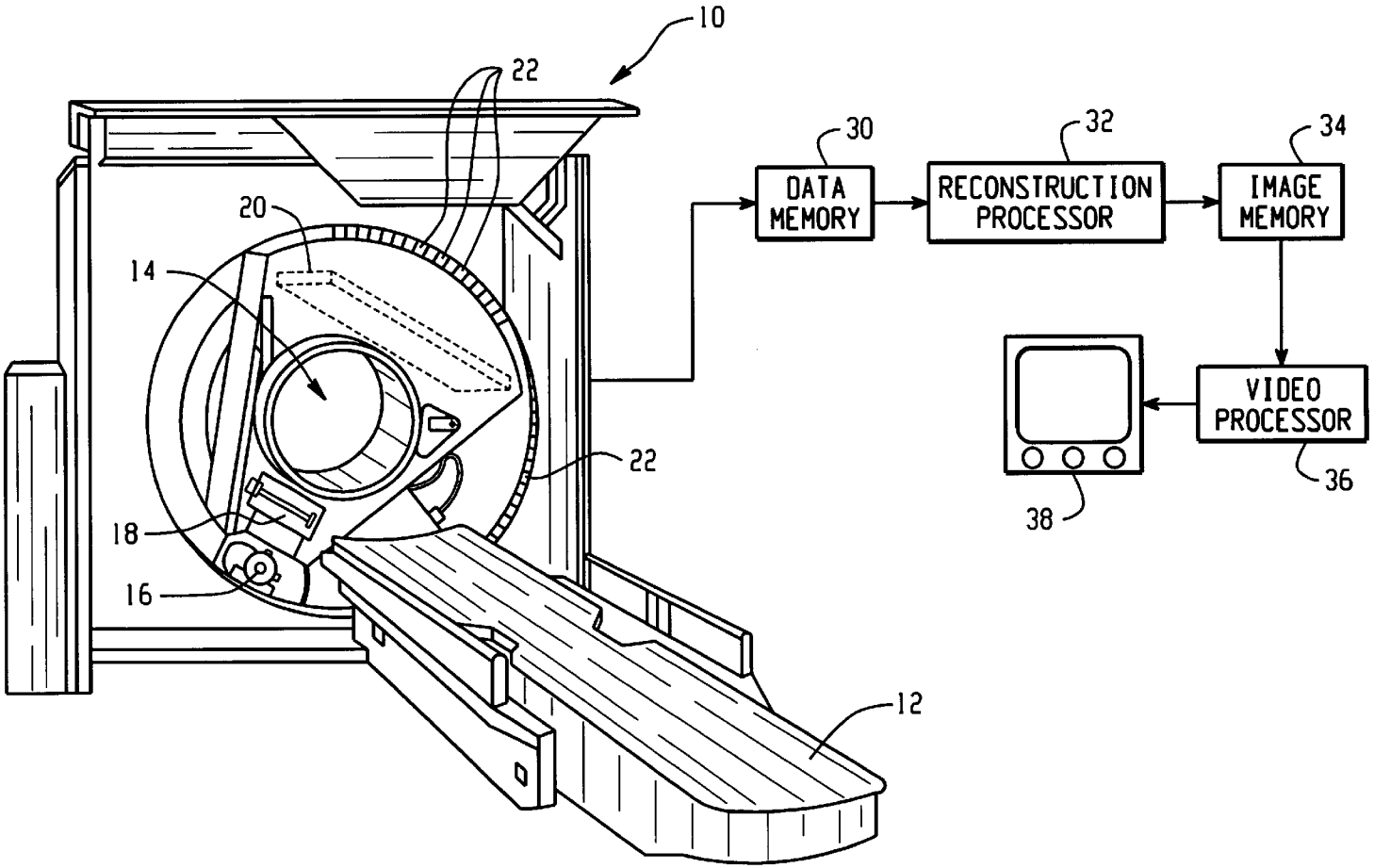
Fig. 1 PRIOR ART
FIG. 1 is a diagrammatic illustration of a prior art computerized tomographic (CT) diagnostic system employing the x-ray tube assembly in accordance with the present invention.

With reference to FIG. 1, a computerized tomographic (CT) scanner 10 radiographically examines and generates diagnostic images of a subject disposed on a patient support 12. More specifically, a volume of interest of the subject on the patient support 12 is moved into an examination region 14. An x-ray tube assembly 16 mounted on a rotating gantry projects one or more beams of radiation through the examination region 14. A collimator 18 collimates the beams of radiation in one dimension. In third generation scanners, an x-ray detector 20 is disposed on the rotating gantry across the examination region 14 from the x-ray tube. In fourth generation scanners, a ring or array of detectors 22 is mounted on the stationary gantry around the rotating gantry.

Each of the x-ray detectors 20, 22 preferably includes a two-dimensional array of photodetectors connected to or preferably integrated into an integrated circuit. The detectors generate electrical signals indicative of the intensity of the received radiation, which is indicative of the integrated x-ray absorption along the corresponding ray between the x-ray tube and the scintillation crystal segment.

The electrical signals, along with information on the angular position of the rotating gantry, are digitized by analog-to-digital converters. The digital diagnostic data is communicated to a data memory 30. The data from the data memory 30 is reconstructed by a reconstruction processor 32. Various known reconstruction techniques are contemplated including spiral and multi-slice scanning techniques, convolution and back projection techniques, cone beam reconstruction techniques, and the like. The volumetric image representations generated by the reconstruction processor are stored in a volumetric image memory 34. A video processor 36 withdraws selective portions of the image memory to create slice images, projection images, surface renderings, and the like, and reformats them for display on a monitor 38 such as a video or LCD monitor.

Figure 2:
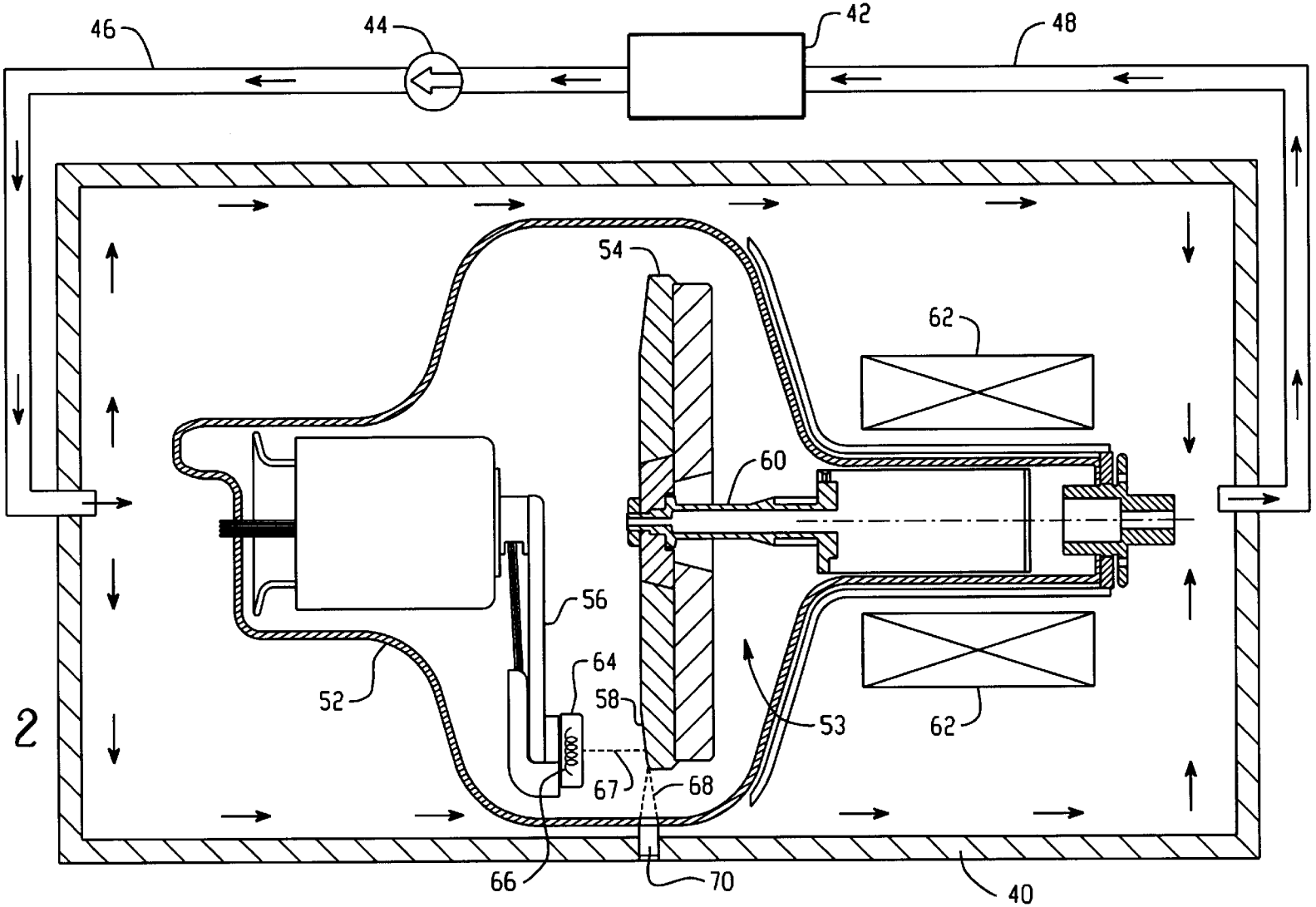
FIG. 2 is a diagrammatic illustration of a preferred embodiment of the x-ray tube assembly in accordance with the present invention.

With reference to FIG. 2 and continuing reference to FIG. 1, the x-ray tube assembly 16 includes a housing 40 filled with a heat transfer and electrically insulating cooling fluid, such as oil. More particularly, the cooling fluid (represented by the arrows) is circulated within the housing 40 through a heat exchanger 42 and through circulation and return lines 46, 48 by a pump 44. An insert frame or envelope 52, preferably comprised of metal, within which an evacuated chamber or vacuum 53 is defined, is supported within the housing 40. An anode assembly 54 and a cathode assembly 56 are disposed at opposite ends of the evacuated envelope 52. An electron beam passes from the cathode assembly 56 to a focal spot on an annular, circumferential race 58 of the anode 54. The anode assembly is mounted to a rotor assembly 60, which is driven by a rotational drive 62, for rotation about an anode axis. The anode assembly includes a target area along a peripheral edge of the anode assembly, which is comprised of a tungsten composite or other suitable material capable of producing x-rays.

The cathode assembly 56 is stationary and includes a cathode focusing cup 64 positioned in a spaced relationship with respect to the target area of the anode assembly for focusing electrons to a focal spot on the target area. A cathode filament 66 mounted to the cathode focusing cup 64 is energized to emit electrons 67, which are accelerated to the target area of the anode assembly in order to produce x-rays. The electrons from the cathode filament 66 are accelerated toward the anode assembly 54 by a large DC electrical potential difference between the cathode and the anode assembly. In one embodiment, the cathode is at an electrical potential of −75,000 volts with respect to ground, and the anode assembly is at an electrical potential of +75,000 volts with respect to ground, thereby providing a bipolar configuration having a total electrical potential difference of 150,000 volts. Impact of the accelerated electrons from the cathode filament 66 onto the focal spot of the anode assembly 54 causes the anode assembly 54 to be heated to a range of between 1100°–1400° C.

Upon striking the target area, a portion of the electrons reflect from the target area and scatter within the evacuated chamber of the envelope. The electrons which are absorbed, as opposed to reflected, by the anode assembly 54 serve to produce x-rays 68. A portion of the x-rays pass through an x-ray transmissive window assembly 70, which is coupled to the envelope 52 towards a patient or subject under examination.

Figure 3:
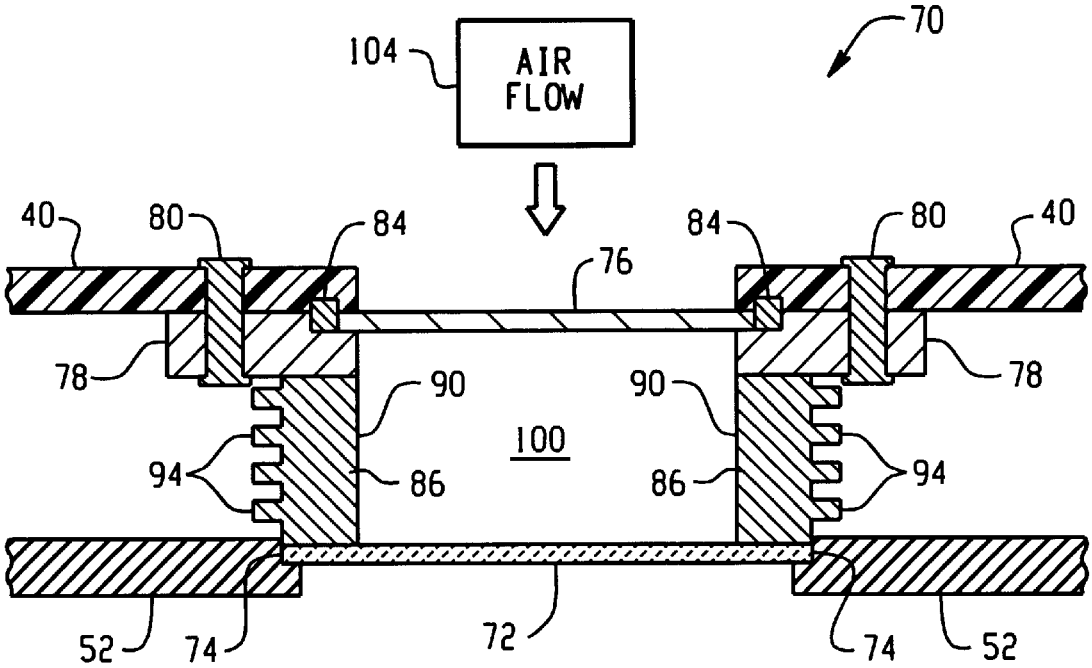
FIG. 3 is a diagrammatic illustration of a preferred embodiment of the liquid-free x-ray window in accordance with the present invention.
Figure 4:
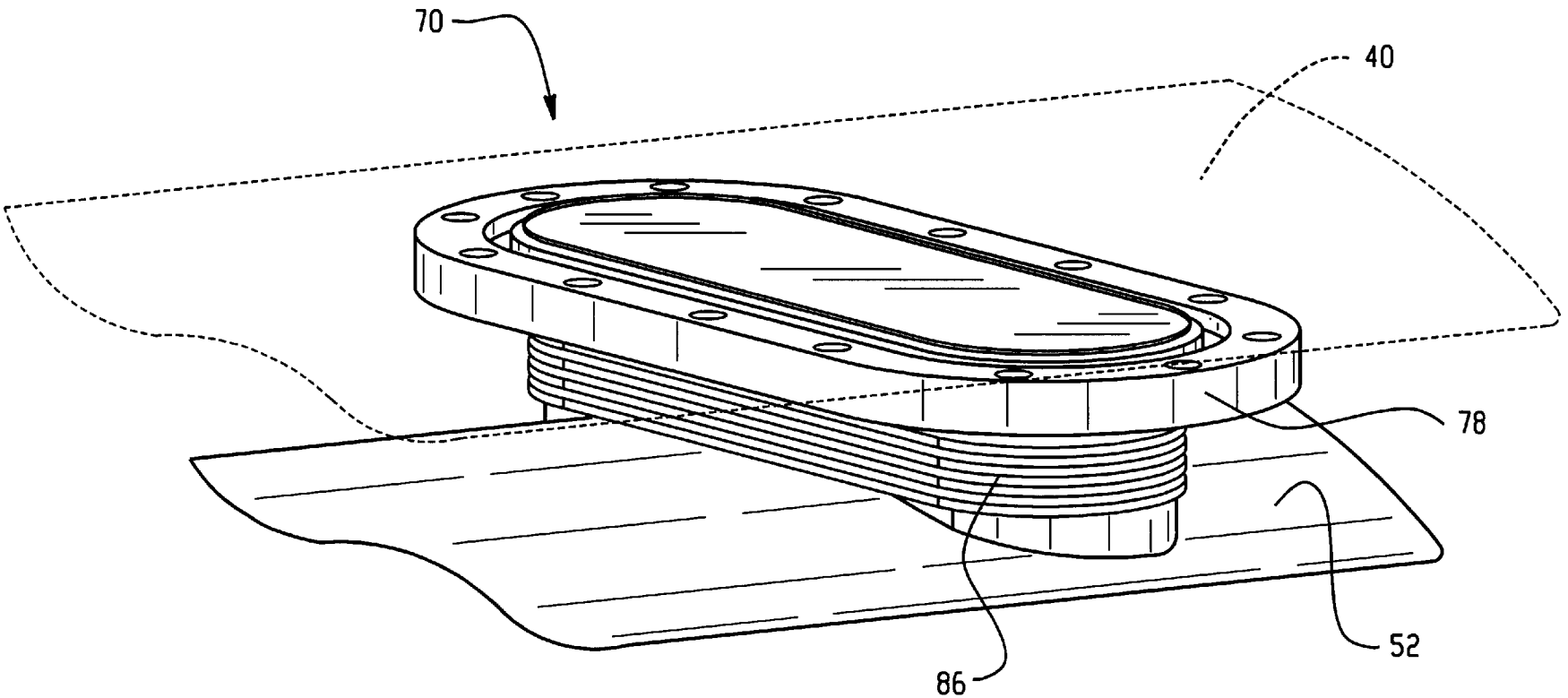
FIG. 4 is a side perspective view of the liquid-free x-ray window in accordance with the present invention.

With reference to FIGS. 3 and 4 and continuing reference to FIG. 2, the x-ray window assembly 70 includes an x-ray transmissive insert window 72, which is hermetically connected to the insert frame 52. The insert window 72 is made of beryllium, titanium, or another suitable x-ray transmissive material. Preferably, the x-ray transmissive insert window 72 is brazed to the insert frame 52 at a braze joint 74, providing an excellent thermal connection between the insert window 72 and the insert frame. The x-ray. window assembly 70 further includes an x-ray transmissive top plate 76 which is connected to and substantially surrounded by a flange 78. The flange 78 is fastened to the x-ray tube housing 40 by a plurality of fasteners 80. The fasteners 80 may include bolts, rivets, screws as well as any other suitable fastener. A sealing member 84, such as an O-ring, is positioned between the x-ray tube housing 52 and the flange 78 in order to prevent the housing from leaking housing cooling fluid.

An annular side plate 86, preferably made of copper or any other highly thermally conducted material, is connected between the flange 78 and the insert frame/insert window 72 at the braze joint 74. The side plate 86 includes a smooth inner surface 90, which is coated with a thermally emissive coating, and an extended outer surface 94, which includes a plurality of cooling fins in thermal contact with the dielectric liquid coolant. As shown in FIG. 3, the insert window 72, top plate 76, the flange 78, and the inner surface 90 of the annular side plate form a window chamber 100. The window chamber 100 is defined by a window chamber surface, which is coated with a thermally emissive coating. In one embodiment, the window chamber 100 contains a non-oxygen gas having a high thermal conductivity. It is to be appreciated that the non-oxygen gas within the window chamber both prevents the window from oxidizing and aids in carrying heat from the window to the side plates.

During operation of the x-ray tube assembly 16, the cooling system 42, 44 circulates the dielectric liquid coolant between the housing 40 and the metal insert frame 52. The x-ray window assembly serves to remove heat from the insert window 72 in such a way that no dielectric liquid coolant comes into direct contact with the insert window 72. It is to be appreciated that preventing liquid coolant from contacting the insert window serves to avoid oil carbonization on the window surface, which provides enhanced x-ray output. More particularly, heat from the insert window 72 is dispersed through thermal conduction along the window 72 to the insert frame 52 and radiation to the side plates 86 and the top plate 76. The heat transferred to the side plates 86 is dissipated through the extended outer surfaces 94 or cooling fins, which are in contact with the dielectric liquid coolant. In one embodiment, an air flow means 104 introduces cold air (shown by the arrow) toward a top surface of the top plate 76 in order to provide additional heat dissipation.

Figure 5:
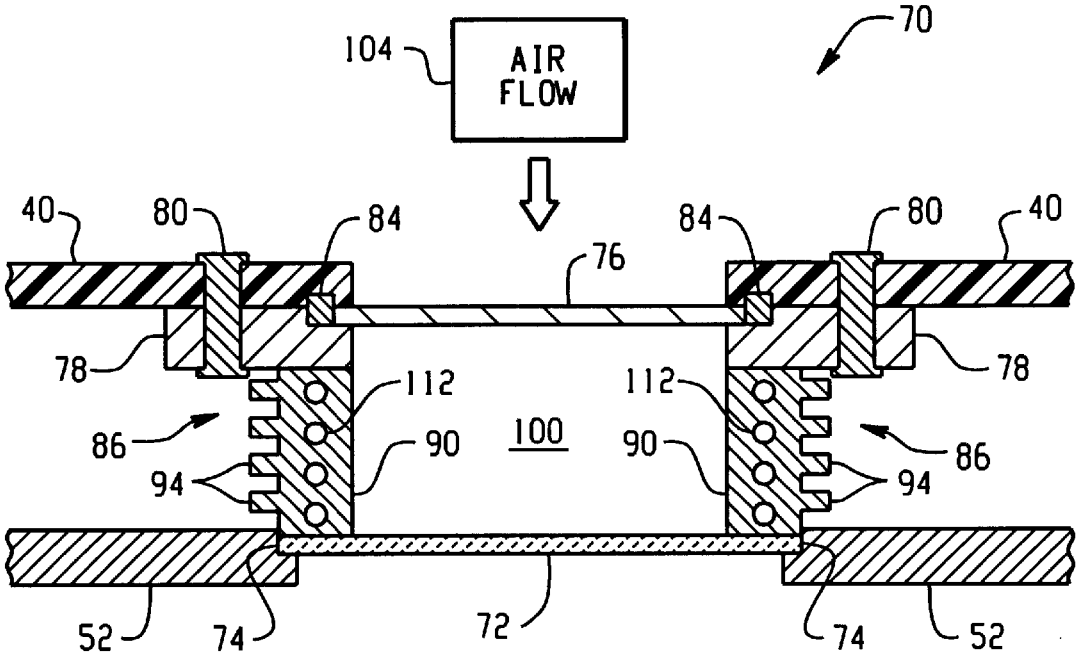
FIG. 5 is a diagrammatic illustration of another preferred embodiment of the liquid-free x-ray window in accordance with the present invention.
Figure 6:
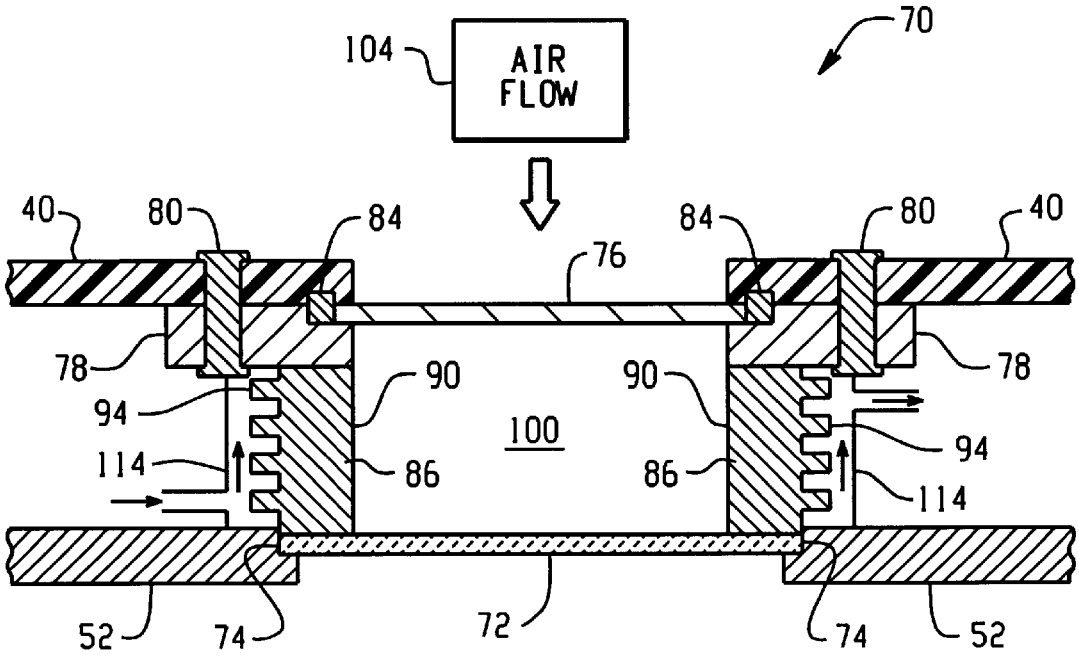
FIG. 6 is a diagrammatic illustration of another preferred embodiment of the liquid-free x-ray window in accordance with the present invention.

With reference to FIGS. 5 and 6 and continuing reference to FIG. 3, in alternate embodiments of the present invention, auxiliary cooling means are placed in thermal contact with the outer extended surface of the annular side plate. In one embodiment, illustrated in FIG. 5, the auxiliary cooling means includes a liquid coil 112, which is embedded within the side plate. In this embodiment, water, oil, or another highly thermal conductive fluid is used as the liquid within the liquid coil. More particularly, a heat exchanger and pump means are placed in fluid communication with the cooling fluid circulation coil. The cooling fluid circulation coil or liquid coil aids in reducing the temperature of the side plate, thus increasing the heat conduction away from the insert window 72.

In an alternate embodiment illustrated in FIG. 6, the auxiliary cooling means takes the form of a cooling jacket 114 which surrounds the extended outer surface 94 of the side plate 86. Again, oil, water or another highly thermal conductive fluid is introduced to the cooling jacket through a heat exchanger and pump means in fluid communication with the cooling jacket. By helping to lower the temperature of the side plate, the cooling jacket 114 increases heat conduction away from the insert window.

Figure 7:
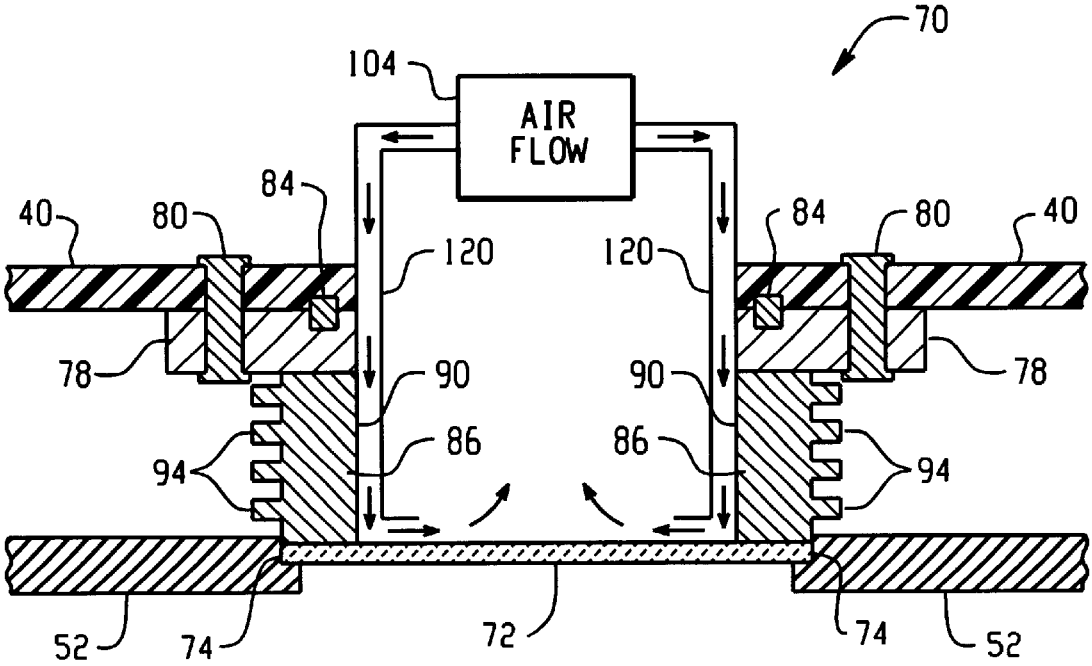
FIG. 7 is a diagrammatic illustration of another preferred embodiment of the liquid-free x-ray window in accordance with the present invention.

With reference to FIG. 7 and continuing reference to FIG. 3, in an embodiment in which oxidation on the insert window 72 does not effect the quality of the x-ray image, the top plate is eliminated. Rather than filling the window chamber with non-oxygen gas, a cold air jet is introduced to the top surface of the insert window 72 through a pair of thin channels 120, which are built adjacent the side plate. Cold air is forced against the top surface of the insert window 72 through the openings at the end of the thin channels 120. In this embodiment, heat transfer away from the insert window 72 is accomplished by both the cold air injection and the thermal radiation/heat conduction achieved via the side plate 86.

The invention has been described with reference to the preferred embodiment. Modifications and alterations will occur to others upon a reading and understanding of the detailed description. Is it intended that the invention be construed as including all such modifications and alterations insofar as they come within the scope of the appended claims or the equivalence thereof.

Having thus described the preferred embodiments, the invention is now claimed to be:

1. An x-ray tube assembly including:

an x-ray tube housing;

a cathode assembly;

a rotating anode assembly;

an insert frame supported within the x-ray tube housing, said insert frame defining a substantially evacuated envelope in which the cathode and anode assemblies operate to produce x-rays;

an x-ray transmissive window assembly which extends between and in a fluid-tight relationship with the x-ray tube housing and the insert frame, the x-ray transmissive window assembly including:

an x-ray transmissive insert window hermetically connected to the insert frame;

an x-ray transmissive top plate connected to and substantially surrounded by a flange, said flange being fastened to the x-ray tube housing; and, an annular side plate having first and second ends, the first end being hermetically connected to at least one of the insert frame and insert window, and the second end is connected to a bottom surface of the flange; and, a dielectric liquid coolant which flows between the x-ray tube housing and the insert frame and around the annular side plate for indirectly cooling the x-ray transmissive window.

2. The x-ray tube assembly according to claim 1, wherein the x-ray transmissive window assembly further includes:

a sealing ring disposed between the x-ray tube housing and the flange such that the sealing ring substantially surrounds the x-ray transmissive top plate.

3. The x-ray tube assembly according to claim 2, wherein the insert window, top plate, flange, and inner surface of the annular side plate form a window chamber having a window chamber surface.

4. The x-ray tube according to claim 3, wherein the window chamber surface is coated with a thermally emissive coating.

5. The x-ray tube assembly according to claim 1, wherein the x-ray transmissive window is made of one of beryllium and titanium.

6. The x-ray tube assembly according to claim 1, further comprising:

an air flow means for introducing cold air to a top surface of the x-ray transmissive top plate.

7. An x-ray tube assembly comprising:

an insert frame defining a substantially evacuated envelope;

a cathode assembly disposed in the evacuated envelope;

a rotating anode assembly disposed in the evacuated envelope;

an x-ray transmissive insert window hermetically connected to the insert frame;

an x-ray tube housing surrounding and spaced from the insert frame;

a dielectric liquid coolant which flows between the x-ray tube housing and the insert frame to cool the frame and the window; and, an x-ray transmissive window cooling assembly including:

an annular, thermally conductive side plate having first and second ends, an inner surface, and an extended outer surface having a plurality of fins in contact with the dielectric liquid coolant, the first end being hermetically connected to and in thermal communication with at least one of the insert frame and insert window, such that heat from the insert window travels from the window through the side plate to the fins and into the liquid coolant;

a flange hermetically connected to and surrounding the side plate second end, the flange being configured for interconnection with the housing; and, an x-ray transmissive top plate connected to and substantially surrounded by the flange.

8. The x-ray tube assembly according to claim 7, wherein the x-ray transmissive window assembly further includes:

an auxiliary cooling means in thermal contact with the annular side plate.

9. The x-ray tube assembly according to claim 8, wherein the auxiliary cooling means includes:

a cooling fluid circulation coil embedded within the annular side plate; and a heat exchanger and pump means in fluid communication with the cooling fluid circulation coil.

10. The x-ray tube assembly according to claim 8, wherein the auxiliary cooling means includes:

a cooling jacket disposed adjacent the annular side plate;

cooling fluid circulation and return lines in fluid communication with the cooling jacket; and, a heat exchanger and pump in fluid communication with the cooling fluid circulation and return lines.

11. An x-ray tube assembly comprising:

an x-ray tube housing;

a cathode assembly;

a rotating anode assembly;

an insert frame supported within the x-ray tube housing, said insert frame defining a substantially evacuated envelope in which the cathode and anode assemblies operate to produce x-rays;

an x-ray transmissive window assembly which extends between and in a fluid-tight relationship with the x-ray tube housing and the insert frame, the x-ray transmissive window assembly including:

an x-ray transmissive insert window hermetically connected to the insert frame;

an annular side plate having first and second ends, the first end being hermetically connected to at least one of the insert frame and insert window, and the second end being connected to the housing, the insert window, and the annular side plate forming a window chamber;

a thermally conductive non-oxygen gas disposed in the window chamber;

a dielectric liquid coolant which flows between the x-ray tube housing and the insert frame and around the annular side plate.

12. An x-ray tube assembly comprising:

a housing;

a cathode assembly;

an anode assembly;

a metal insert frame disposed within the housing and defining an evacuated envelope in which the cathode and anode assemblies operate to produce x-rays;

a cooling means which circulates a dielectric liquid coolant between the housing and the metal insert frame;

an x-ray transmissive window through which x-rays produced by the cathode and anode assemblies pass, said window being brazed to the insert frame at a braze joint in a vacuum-tight manner; and, a heat conducting means in thermal contact with the x-ray transmissive window at the braze joint, said heat conducting means removing heat from the window and the braze joint without liquid coolant passing over the window.

13. The x-ray tube assembly according to claim 12, wherein the heat conducting means includes:

a thermally conductive annular side plate having a first end surrounding the x-ray transmissive window in a fluid-tight relationship with the braze joint, and a second end in fluid-tight relationship with the housing through a flange.

14. An x-ray tube assembly comprising:

a housing;

a cathode assembly;

an anode assembly;

a metal insert frame disposed within the housing, said metal insert frame defining an evacuated envelope in which the cathode and anode assemblies operate to produce x-rays;

an x-ray transmissive window through which x-rays produced by the cathode and anode assemblies pass, said window being brazed to the insert frame at a braze joint in a vacuum-tight manner; and, a cooling system which circulates a dielectric liquid coolant between the housing and the metal insert frame;

a window cooling assembly including a thermally conductive annular side plate, the annular side plate including:

a first end surrounding the x-ray transmissive window in a heat transmitting fluid-tight relationship with the braze joint;

a plurality of outward extending radial fins in thermal contact with the dielectric liquid coolant; and, a second end in fluid-tight relationship with the housing;

such that said cooling assembly removes heat from the window without liquid coolant passing over the window.

15. The x-ray tube assembly according to claim 14, wherein the cooling assembly further includes:

a top plate which is brazed to the flange, forming a window chamber above the x-ray transmissive window.

16. The x-ray tube assembly according to claim 15, wherein the window chamber is filled with a thermally conductive non-oxygen gas.

17. The x-ray tube assembly according to claim 14, wherein the annular side plate includes an auxiliary cooling coil embedded therein.

18. The x-ray tube assembly according to claim 14, wherein the annular side plate is substantially surrounded by a cooling jacket through which a second liquid coolant is circulated.

19. An x-ray tube assembly comprising:

a housing;

a cathode assembly;

an anode assembly;

an insert frame disposed within the housing, said insert frame defining an evacuated envelope in which the cathode and anode assemblies operate to produce x-rays;

an x-ray transmissive window through which x-rays produced by the cathode and anode assemblies pass, said window being mounted to the insert frame in a vacuum-tight manner;

a cooling system which circulates a dielectric liquid coolant between the housing and the metal insert frame;

an annular side plate including:

a first end surrounding the x-ray transmissive window in a fluid-tight relationship;

a second end in fluid-tight relationship with the housing;

a cold air generator which forces cold air toward a top surface of the x-ray transmissive window through a plurality of channels adjacent an inner surface of the annular side plate to remove heat from the window without the liquid coolant passing over the window.

20. In a high power x-ray tube assembly having an outer housing, a metal insert frame supported within the outer housing which defines an evacuated envelope in which cathode and rotating anode assemblies operate to produce x-rays, and an x-ray transmissive insert window brazed to the insert frame at a braze joint, a method of high heat transfer cooling of the x-ray transmissive insert window in which no liquid coolant oil contacts the x-ray transmissive window, the method including:

from a thermally conductive material, forming an oil-free cooling chamber around and above the x-ray transmissive window;

conducting heat from the window through the thermally conductive material; and, circulating the coolant oil around the oil-free cooling chamber to remove heat from the thermally conductive material.

21. The method according to claim 20, wherein the step of forming the oil-free cooling chamber includes:

connecting an annular metal element of the thermally conductive material in a fluid-tight relationship with (i) the x-ray transmissive insert window and the insert frame at the braze joint, and (ii) the outer housing.

22. The method according to claim 21, further including:

blowing cold air toward the x-ray transmissive insert window.

23. The method according to claim 21, further including:

positioning an auxiliary cooling means in thermal contact with the annular metal element.

* * * * *